US010490881B2

(12) United States Patent
Azad et al.

(10) Patent No.: US 10,490,881 B2
(45) Date of Patent: Nov. 26, 2019

(54) TUNING CIRCUITS FOR HYBRID ELECTRONIC DEVICE ANTENNAS

(71) Applicant: Apple Inc., Cupertino, CA (US)

(72) Inventors: Umar Azad, San Jose, CA (US); Harish Rajagopalan, San Jose, CA (US); Rodney A. Gomez Angulo, Sunnyvale, CA (US); Pietro Romano, Mountain View, CA (US); Mattia Pascolini, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 720 days.

(21) Appl. No.: 15/066,419

(22) Filed: Mar. 10, 2016

(65) Prior Publication Data

US 2017/0264001 A1 Sep. 14, 2017

(51) Int. Cl.

| | |
|---|---|
| ***H01Q 1/24*** | (2006.01) |
| ***H01Q 9/04*** | (2006.01) |
| ***H01Q 5/328*** | (2015.01) |

(52) U.S. Cl.
CPC ..... *H01Q 1/243* (2013.01); *H01Q 5/328* (2015.01); *H01Q 9/0442* (2013.01)

(58) Field of Classification Search
CPC ..... H01Q 1/24; H01Q 1/243; H01Q 9/0442; H01Q 9/0407
See application file for complete search history.

(56) References Cited

U.S. PATENT DOCUMENTS

| | | | |
|---|---|---|---|
| 4,016,490 | A | 4/1977 | Weckenmann et al. |
| 4,614,937 | A | 9/1986 | Poujois |
| 5,337,353 | A | 8/1994 | Boie et al. |
| 5,410,497 | A | 4/1995 | Viletto |
| 5,463,406 | A | 10/1995 | Vannatta et al. |
| 5,650,597 | A | 7/1997 | Redmayne |
| 5,826,458 | A | 10/1998 | Little |

(Continued)

FOREIGN PATENT DOCUMENTS

| | | |
|---|---|---|
| CN | 1343380 | 4/2002 |
| CN | 1543010 | 11/2004 |

(Continued)

OTHER PUBLICATIONS

Pascolini et al., U.S. Appl. No. 14/710,377, filed May 12, 2015.

(Continued)

*Primary Examiner* — Daniel Munoz
(74) *Attorney, Agent, or Firm* — Treyz Law Group, P.C.; Tianyi He; Michael H. Lyons

(57) ABSTRACT

An electronic device may have hybrid antennas that include slot antenna resonating elements formed from slots in a ground plane and planar inverted-F antenna resonating elements. The planar inverted-F antenna resonating elements may each have a planar metal member that overlaps one of the slots. A return path and feed may be coupled in parallel between the planar metal member and the ground plane. Adjustable circuits such as tunable inductors may be used to tune the hybrid antennas. Adjustable circuits may bridge the slots in hybrid antennas and may be included in return paths that are coupled between the planar metal members of the planar inverted-F antenna resonating elements and the ground plane. A slot may be selectively divided to from two slots using switching circuitry.

21 Claims, 9 Drawing Sheets

(56) References Cited

U.S. PATENT DOCUMENTS 5,854,972 A 12/1998 Pennock et al.
5,864,316 A 1/1999 Bradley et al.
5,905,467 A 5/1999 Narayanaswamy et al.
5,956,626 A 9/1999 Kashke et al.
6,181,281 B1 1/2001 Desclos
6,301,489 B1 10/2001 Winstead et al.
6,329,958 B1 12/2001 McLean et al.
6,380,899 B1 4/2002 Madsen et al.
6,408,193 B1 6/2002 Katagishi et al.
6,445,906 B1 9/2002 Nguyen et al.
6,456,856 B1 9/2002 Werling et al.
6,480,162 B2 11/2002 Sabet
6,529,088 B2 3/2003 Lafleur et al.
6,590,539 B2 7/2003 Shinichi
6,611,227 B1 8/2003 Nebiyeloul-Kifle et al.
6,657,595 B1 12/2003 Phillips et al.
6,678,532 B1 1/2004 Mizoguchi
6,741,214 B1 5/2004 Kadambi et al.
6,788,266 B2 9/2004 St. Hillaire
6,879,293 B2 4/2005 Sato
6,975,276 B2 12/2005 Brown
6,978,121 B1 12/2005 Lane et al.
6,985,108 B2 1/2006 Mikkola
6,985,113 B2 1/2006 Nishimura et al.
7,016,686 B2 3/2006 Spaling
7,039,435 B2 5/2006 McDowell et al.
7,050,010 B2 5/2006 Wang et al.
7,109,945 B2 9/2006 Mori
7,113,087 B1 9/2006 Casebolt
7,146,139 B2 12/2006 Nevermann
7,221,092 B2 5/2007 Anzai et al.
7,356,361 B1 4/2008 Hawkins et al.
7,388,550 B2 6/2008 McLean
7,499,722 B2 3/2009 McDowell et al.
7,502,221 B2 3/2009 Fuller et al.
7,522,846 B1 4/2009 Lewis et al.
7,538,760 B2 5/2009 Hotelling et al.
7,551,142 B1 6/2009 Zhang et al.
7,557,760 B2 7/2009 Chang et al.
7,595,788 B2 9/2009 Son
7,633,076 B2 12/2009 Huppi et al.
7,663,612 B2 2/2010 Bladt
7,705,787 B2 4/2010 Ponce De Leon
7,826,875 B2 11/2010 Karaoguz et al.
7,834,813 B2 11/2010 Caimi et al.
7,864,123 B2 1/2011 Hill et al.
7,876,274 B2 1/2011 Hobson et al.
7,999,748 B2 8/2011 Lightenberg et al.
8,059,039 B2 11/2011 Ayala Vazquez et al.
8,059,040 B2 11/2011 Ayala Vazquez et al.
8,115,753 B2 2/2012 Newton
8,159,399 B2 4/2012 Dorsey et al.
8,228,198 B2 7/2012 McAllister
8,238,971 B2 8/2012 Terlizzi
8,255,009 B2 8/2012 Sorenson et al.
8,270,914 B2 9/2012 Pascolini et al.
8,319,692 B2 11/2012 Chiang et al.
8,325,094 B2 12/2012 Ayala Vazquez et al.
8,326,221 B2 12/2012 Dorsey et al.
8,347,014 B2 1/2013 Schubert et al.
8,368,602 B2 2/2013 Hill
8,417,296 B2 4/2013 Caballero et al.
8,432,322 B2 4/2013 Amm et al.
8,436,816 B2 5/2013 Leung et al.
8,466,839 B2 6/2013 Schlub et al.
8,497,806 B2 7/2013 Lai
8,517,383 B2 8/2013 Wallace et al.
8,525,734 B2 9/2013 Krogerus
8,531,337 B2 9/2013 Soler Castany et al.
8,577,289 B2 11/2013 Schlub et al.
8,610,629 B2 12/2013 Pascolini et al.
8,638,266 B2 1/2014 Liu
8,638,549 B2 1/2014 Garelli et al.
8,648,752 B2 2/2014 Ramachandran et al.
8,749,523 B2 6/2014 Pance et al.
8,781,420 B2 7/2014 Schlub et al.
8,798,554 B2 8/2014 Darnell et al.
8,836,587 B2 9/2014 Darnell et al.
8,872,706 B2 10/2014 Caballero et al.
8,896,488 B2 11/2014 Ayala Vazquez et al.
8,947,302 B2 2/2015 Caballero et al.
8,947,305 B2 2/2015 Amm et al.
8,952,860 B2 2/2015 Li et al.
8,963,782 B2 2/2015 Ayala Vazquez et al.
8,963,784 B2 2/2015 Zhu et al.
9,024,823 B2 5/2015 Bevelacqua
9,093,752 B2 7/2015 Yarga et al.
9,153,874 B2 10/2015 Ouyang et al.
9,257,750 B2 2/2016 Vazquez et al.
9,276,319 B2 3/2016 Vazquez et al.
9,293,828 B2 3/2016 Bevelacqua et al.
9,300,342 B2 3/2016 Schlub et al.
9,331,397 B2 5/2016 Jin et al.
9,337,537 B2 5/2016 Hu et al.
2002/0015024 A1 2/2002 Westerman et al.
2002/0027474 A1 3/2002 Bonds
2002/0060645 A1 5/2002 Shinichi
2002/0094789 A1 7/2002 Harano
2002/0123309 A1 9/2002 Collier et al.
2003/0062907 A1 4/2003 Nevermann
2003/0186728 A1 10/2003 Manjo
2003/0193438 A1 10/2003 Yoon
2003/0197597 A1 10/2003 Bahl et al.
2003/0210203 A1 11/2003 Phillips et al.
2003/0218993 A1 11/2003 Moon et al.
2004/0051670 A1 3/2004 Sato
2004/0080457 A1 4/2004 Guo et al.
2004/0104853 A1 6/2004 Chen
2004/0176083 A1 9/2004 Shiao et al.
2004/0189542 A1 9/2004 Mori
2004/0222926 A1 11/2004 Kontogeorgakis et al.
2004/0239575 A1 12/2004 Shoji
2005/0146475 A1 7/2005 Bettner
2005/0168384 A1 8/2005 Wang et al.
2005/0243001 A1* 11/2005 Miyata ..... H01Q 1/243 343/702
2005/0245204 A1 11/2005 Vance
2005/0264466 A1 12/2005 Hibino et al.
2006/0001576 A1 1/2006 Contopanagos
2006/0152497 A1 7/2006 Rekimoto
2006/0161871 A1 7/2006 Hotelling et al.
2006/0232468 A1 10/2006 Parker et al.
2006/0244663 A1 11/2006 Fleck et al.
2006/0248363 A1 11/2006 Chen et al.
2006/0274493 A1 12/2006 Richardson et al.
2006/0278444 A1 12/2006 Binstead
2007/0120740 A1 5/2007 Iellici et al.
2007/0126711 A1 6/2007 Oshita
2007/0188375 A1 8/2007 Richards et al.
2007/0239921 A1 10/2007 Toorains et al.
2008/0165063 A1* 7/2008 Schlub ..... H01Q 1/243 343/702
2008/0246735 A1 10/2008 Reynolds et al.
2008/0248837 A1 10/2008 Kunkel
2008/0297487 A1 12/2008 Hotelling et al.
2008/0309836 A1 12/2008 Sakama et al.
2008/0316120 A1 12/2008 Hirota et al.
2009/0000023 A1 1/2009 Wegelin et al.
2009/0096683 A1 4/2009 Rosenblatt et al.
2009/0128435 A1 5/2009 Jeng
2009/0153407 A1 6/2009 Zhang et al.
2009/0153410 A1 6/2009 Chiang
2009/0174611 A1 7/2009 Schlub et al.
2009/0256757 A1 10/2009 Chiang
2009/0256758 A1 10/2009 Schlub et al.
2009/0295648 A1 12/2009 Dorsey et al.
2010/0062728 A1 3/2010 Black et al.
2010/0079351 A1 4/2010 Huang et al.
2010/0081374 A1 4/2010 Moosavi
2010/0109971 A2 5/2010 Gummalla et al.
2010/0167672 A1 7/2010 Ahn et al.
2010/0182203 A1 7/2010 See
2010/0238072 A1 9/2010 Ayatollahi et al.
2010/0253651 A1 10/2010 Day

(56) References Cited

U.S. PATENT DOCUMENTS

| | | | | |
|---|---|---|---|---|
| 2011/0012793 | A1 | 1/2011 | Amm et al. | |
| 2011/0012794 | A1 | 1/2011 | Schlub et al. | |
| 2011/0045789 | A1 | 2/2011 | Sinton et al. | |
| 2011/0050509 | A1 | 3/2011 | Ayala Vazquez et al. | |
| 2011/0212746 | A1 | 9/2011 | Sarkar et al. | |
| 2011/0241949 | A1 | 10/2011 | Nickel et al. | |
| 2011/0260924 | A1 | 10/2011 | Roy | |
| 2011/0260939 | A1 | 10/2011 | Korva et al. | |
| 2011/0300907 | A1 | 12/2011 | Hill et al. | |
| 2012/0009983 | A1 | 1/2012 | Mow et al. | |
| 2012/0068893 | A1 | 3/2012 | Guterman et al. | |
| 2012/0092298 | A1 | 4/2012 | Koottungal | |
| 2012/0112969 | A1 | 5/2012 | Caballero et al. | |
| 2012/0112970 | A1 | 5/2012 | Caballero et al. | |
| 2012/0176279 | A1 | 7/2012 | Merz et al. | |
| 2012/0214412 | A1 | 8/2012 | Schlub et al. | |
| 2012/0223865 | A1 | 9/2012 | Li et al. | |
| 2012/0223866 | A1 | 9/2012 | Ayala Vazquez et al. | |
| 2012/0229360 | A1 | 9/2012 | Jagielski et al. | |
| 2012/0299785 | A1 | 11/2012 | Bevelacqua | |
| 2013/0050038 | A1 | 2/2013 | Eom et al. | |
| 2013/0082884 | A1 | 4/2013 | Gummalla | |
| 2013/0106660 | A1 | 5/2013 | Kang | |
| 2013/0115884 | A1 | 5/2013 | Zhang | |
| 2013/0154900 | A1 | 6/2013 | Tsai et al. | |
| 2013/0169490 | A1 | 7/2013 | Pascolini et al. | |
| 2013/0201067 | A1 | 8/2013 | Hu et al. | |
| 2013/0203364 | A1 | 8/2013 | Darnell et al. | |
| 2013/0234910 | A1 | 9/2013 | Oh et al. | |
| 2013/0241800 | A1 | 9/2013 | Schlub et al. | |
| 2013/0257659 | A1 | 10/2013 | Darnell et al. | |
| 2013/0285857 | A1 | 10/2013 | Schlutz | |
| 2013/0293425 | A1 | 11/2013 | Zhu et al. | |
| 2013/0321216 | A1 | 12/2013 | Jervis et al. | |
| 2013/0328730 | A1 | 12/2013 | Guterman et al. | |
| 2013/0333496 | A1 | 12/2013 | Boutouil et al. | |
| 2013/0342411 | A1 | 12/2013 | Jung | |
| 2014/0009352 | A1 | 1/2014 | Sung | |
| 2014/0086441 | A1 | 3/2014 | Zhu et al. | |
| 2014/0184450 | A1 | 7/2014 | Koo | |
| 2014/0266922 | A1* | 9/2014 | Jin | H01Q 21/28 343/702 |
| 2014/0266923 | A1 | 9/2014 | Zhou et al. | |
| 2014/0266938 | A1* | 9/2014 | Ouyang | H01Q 5/321 343/729 |
| 2014/0266941 | A1 | 9/2014 | Vazquez et al. | |
| 2014/0292587 | A1 | 10/2014 | Yarga et al. | |
| 2014/0292598 | A1 | 10/2014 | Bevelacqua et al. | |
| 2014/0306857 | A1 | 10/2014 | Bevelacqua et al. | |
| 2014/0313087 | A1 | 10/2014 | Jiang et al. | |
| 2014/0328488 | A1 | 11/2014 | Caballero et al. | |
| 2014/0333495 | A1 | 11/2014 | Vazquez et al. | |
| 2014/0340265 | A1 | 11/2014 | Vazquez et al. | |
| 2014/0375509 | A1 | 12/2014 | Vance et al. | |
| 2015/0180123 | A1 | 6/2015 | Tatomirescu | |
| 2015/0236426 | A1 | 8/2015 | Zhu et al. | |
| 2015/0255851 | A1 | 9/2015 | Guterman et al. | |
| 2015/0257158 | A1 | 9/2015 | Jadhav et al. | |
| 2015/0270618 | A1 | 9/2015 | Zhu et al. | |
| 2015/0270619 | A1 | 9/2015 | Zhu et al. | |
| 2015/0311594 | A1 | 10/2015 | Zhu et al. | |

FOREIGN PATENT DOCUMENTS

| | | |
|---|---|---|
| CN | 101330162 | 12/2008 |
| DE | 102005035935 | 2/2007 |
| EP | 0086135 | 8/1983 |
| EP | 0 564 164 | 10/1993 |
| EP | 1298809 | 4/2003 |
| EP | 1324425 | 7/2003 |
| EP | 1361623 | 11/2003 |
| EP | 1 469 550 | 10/2004 |
| EP | 1 524 774 | 4/2005 |
| EP | 1564896 | 8/2005 |
| EP | 1593988 | 11/2005 |
| GB | 2 380 359 | 4/2003 |
| JP | 05-128828 | 5/1993 |
| JP | 2003179670 | 6/2003 |
| JP | 2003209483 | 7/2003 |
| JP | 2003330618 | 11/2003 |
| JP | 2004005516 | 1/2004 |
| JP | 200667061 | 3/2006 |
| JP | 2007-170995 | 7/2007 |
| JP | 2008046070 | 2/2008 |
| JP | 2009032570 | 2/2009 |
| WO | 0131733 | 5/2001 |
| WO | 02/05443 | 1/2002 |
| WO | 2004010528 | 9/2004 |
| WO | 2004112187 | 12/2004 |
| WO | 2005112280 | 11/2005 |
| WO | 2007116790 | 4/2006 |
| WO | 2006060232 | 6/2006 |
| WO | 2007124333 | 1/2007 |
| WO | 2008/078142 | 7/2008 |
| WO | 2009022387 | 2/2009 |
| WO | 2009149023 | 12/2009 |
| WO | 2011022067 | 2/2011 |
| WO | 2013123109 | 8/2013 |
| WO | 2013165419 | 11/2013 |

OTHER PUBLICATIONS

The ARRL Antenna Book, Published by the American Radio League, 1998, 15th Edition, ISBN: 1-87259-206-5.

Myllmaki et al., "Capacitive recognition of the user's hand grip position in mobile handsets", Progress in Electromagnetics Research B, vol. 22, 2010, pp. 203-220.

"CapTouch Programmable Controller for Single-Electrode Capacitance Sensors", AD7147 Data Sheet Rev. B, [online], Analog Devices, Inc., [retrieved on Dec. 7, 2009], URL: http://www.analog.com/static/imported-files/data_sheets/AD7147.pdf>.

Liu et al., MEMS-Switched, Frequency-Tunable Hybrid Slot/PIFA Antenna; IEEE Antennas and Wireless Propagation Letters, vol. 8, 2009; p. 311-314.

Pance et al., U.S. Appl. No. 61/235,905, filed Aug. 21, 2009.

* cited by examiner

TUNING CIRCUITS FOR HYBRID ELECTRONIC DEVICE ANTENNAS

BACKGROUND

This relates to electronic devices, and more particularly, to antennas for electronic devices with wireless communications circuitry.

Electronic devices such as portable computers and cellular telephones are often provided with wireless communications capabilities. To satisfy consumer demand for small form factor wireless devices, manufacturers are continually striving to implement wireless communications circuitry such as antenna components using compact structures. At the same time, there is a desire for wireless devices to cover a growing number of communications bands.

Because antennas have the potential to interfere with each other and with components in a wireless device, care must be taken when incorporating antennas into an electronic device. Moreover, care must be taken to ensure that the antennas and wireless circuitry in a device are able to exhibit satisfactory performance over a range of operating frequencies.

It would therefore be desirable to be able to provide improved wireless communications circuitry for wireless electronic devices.

SUMMARY

An electronic device may have a metal housing that forms a ground plane. The ground plane may, for example, be formed from a rear housing wall and sidewalls. The ground plane and other structures in the electronic device may be used in forming antennas.

The electronic device may include one or more hybrid antennas. The hybrid antennas may each include a slot antenna resonating element formed from a slot in the ground plane and a planar inverted-F antenna resonating element. The planar inverted-F antenna resonating element may serve as indirect feed structure for the slot antenna resonating element.

A planar inverted-F antenna resonating element may have a planar metal member that overlaps one of the slot antenna resonating elements. The slot of the slot antenna resonating element may divide the ground plane into first and second portions. A return path and feed may be coupled in parallel between the planar metal member and the first portion of the ground plane. The return path may include a tunable component. For example, the return path may include an adjustable inductor formed from inductors and switching circuitry.

A set of one or more switches may bridge a dielectric-filled slot in the metal housing and thereby form first and second slots for first and second hybrid antennas. During normal operation, the switches may be closed to form the first and second slots. When antenna operation is influenced by external objects adjacent to one of the antennas, the switches may be opened. This joins the first and second slots together and forms a single larger slot that is open at each end and less sensitive to influence to from external objects.

Tunable components such as tunable inductors may be used to tune the hybrid antennas. A tunable inductor may bridge the slot in a hybrid antenna, may be coupled between the planar metal member of the planar inverted-F antenna resonating element and the ground plane, or multiple tunable inductors may bridge the slot on opposing sides of the planar inverted-F antenna resonating element.

DETAILED DESCRIPTION

Figure 1:
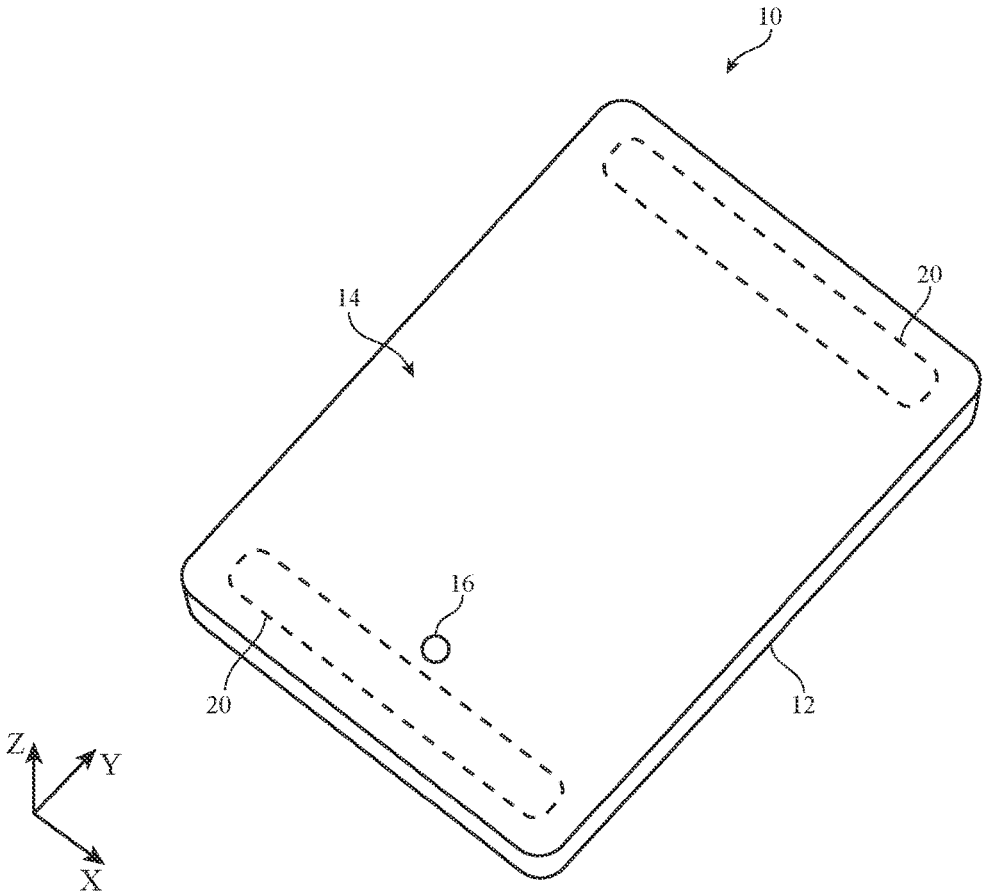
FIG. 1 is a front perspective view of an illustrative electronic device in accordance with an embodiment.

An electronic device such as electronic device 10 of FIG. 1 may be provided with wireless circuitry that includes antenna structures. The antenna structures may include hybrid antennas. The hybrid antennas may be hybrid planar-inverted-F-slot antennas that include slot antenna resonating elements and planar inverted-F antenna resonating elements. The planar inverted-F antenna resonating elements may indirectly feed the slot antenna resonating elements and may contribute to the frequency responses of the antennas. Slots for the slot antenna resonating elements may be formed in ground structures such as conductive housing structures and may be filled with a dielectric such as plastic.

The wireless circuitry of device 10 may handles one or more communications bands. For example, the wireless circuitry of device 10 may include a Global Position System (GPS) receiver that handles GPS satellite navigation system signals at 1575 MHz or a GLONASS receiver that handles GLONASS signals at 1609 MHz. Device 10 may also contain wireless communications circuitry that operates in communications bands such as cellular telephone bands and wireless circuitry that operates in communications bands such as the 2.4 GHz Bluetooth® band and the 2.4 GHz and 5 GHz WiFi® wireless local area network bands (sometimes referred to as IEEE 802.11 bands or wireless local area network communications bands). Device 10 may also contain wireless communications circuitry for implementing near-field communications at 13.56 MHz or other near-field communications frequencies. If desired, device 10 may include wireless communications circuitry for communicating at 60 GHz, circuitry for supporting light-based wireless communications, or other wireless communications.

Electronic device 10 may be a computing device such as a laptop computer, a computer monitor containing an embedded computer, a tablet computer, a cellular telephone, a media player, or other handheld or portable electronic device, a smaller device such as a wrist-watch device, a pendant device, a headphone or earpiece device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment. In the illustrative configuration of FIG. 1, device 10 is a portable device such as a cellular telephone, media player, tablet computer, or other portable computing device. Other configurations may be used for device 10 if desired. The example of FIG. 1 is merely illustrative.

In the example of FIG. 1, device 10 includes a display such as display 14. Display 14 has been mounted in a housing such as housing 12. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials. Housing 12 may be formed using a unibody configuration in which some or all of housing 12 is machined or molded as a single structure or may be formed using multiple structures (e.g., an internal frame structure, one or more structures that form exterior housing surfaces, etc.).

Display 14 may be a touch screen display that incorporates a layer of conductive capacitive touch sensor electrodes or other touch sensor components (e.g., resistive touch sensor components, acoustic touch sensor components, force-based touch sensor components, light-based touch sensor components, etc.) or may be a display that is not touch-sensitive. Capacitive touch screen electrodes may be formed from an array of indium tin oxide pads or other transparent conductive structures.

Display 14 may include an array of display pixels formed from liquid crystal display (LCD) components, an array of electrophoretic display pixels, an array of plasma display pixels, an array of organic light-emitting diode display pixels, an array of electrowetting display pixels, or display pixels based on other display technologies.

Display 14 may be protected using a display cover layer such as a layer of transparent glass or clear plastic. Openings may be formed in the display cover layer. For example, an opening may be formed in the display cover layer to accommodate a button such as button 16. An opening may also be formed in the display cover layer to accommodate ports such as a speaker port. Openings may be formed in housing 12 to form communications ports (e.g., an audio jack port, a digital data port, etc.). Openings in housing 12 may also be formed for audio components such as a speaker and/or a microphone.

Antennas may be mounted in housing 12. For example, housing 12 may have four peripheral edges as shown in FIG. 1 and one or more antennas may be located along one or more of these edges. As shown in the illustrative configuration of FIG. 1, antennas may, if desired, be mounted in regions 20 along opposing peripheral edges of housing 12 (as an example). The antennas may include slots in the rear of housing 12 in regions such as regions 20 and may emit and receive signals through the front of device 10 (i.e., through inactive portions of display 14) and/or through the rear of device 10. Antennas may also be mounted in other portions of device 10, if desired. The configuration of FIG. 1 is merely illustrative.

Figure 2:
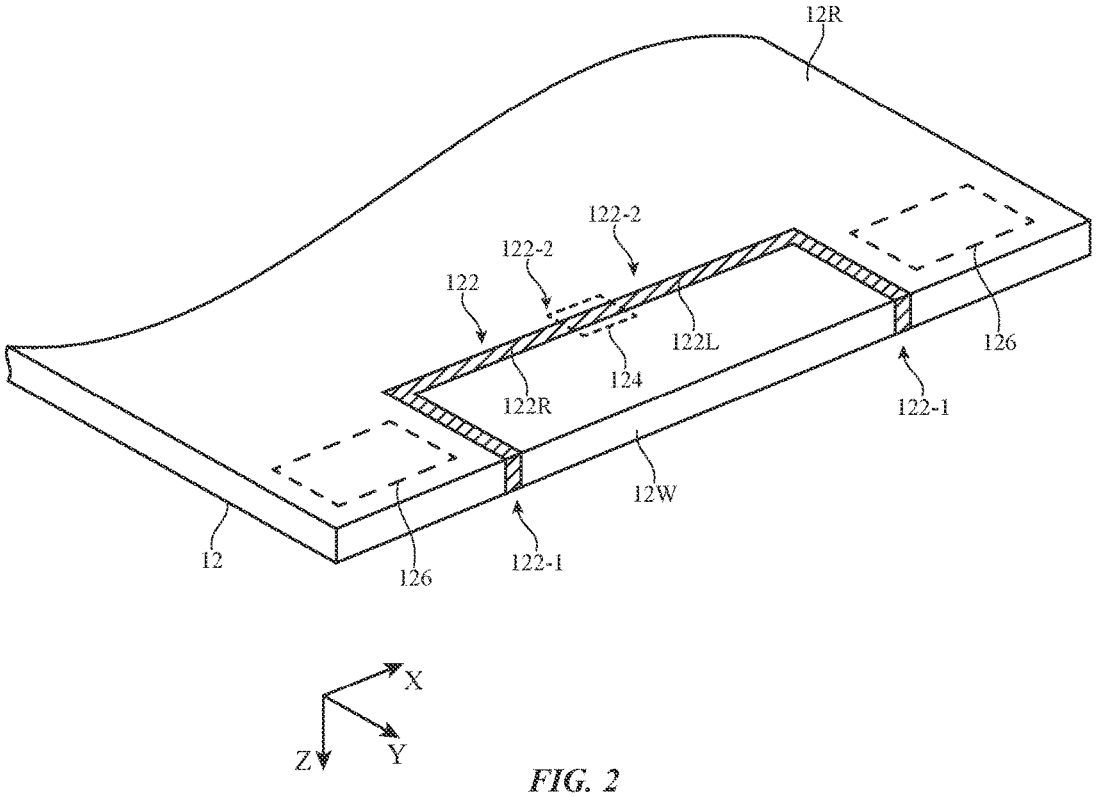
FIG. 2 is a rear perspective view of a portion of the illustrative electronic device of FIG. 1 in accordance with an embodiment.

FIG. 2 is a rear perspective view of the upper end of housing 12 and device 10 of FIG. 1. As shown in FIG. 2, one or more slots such as slot 122 may be formed in housing 12. Housing 12 may be formed from a conductive material such as metal. Slot 122 may be an elongated opening in the metal of housing 12 and may be filled with a dielectric material such as glass, ceramic, plastic, or other insulator (i.e., slot 122 may be a dielectric-filled slot). The width of slot 122 may be 0.1-1 mm, less than 1.3 mm, less than 1.1 mm, less than 0.9 mm, less than 0.7 mm, less than 0.5 mm, less than 0.3 mm, more than 0.2 mm, more than 0.5 mm, more than 0.1 mm, 0.2-0.9 mm, 0.2-0.7 mm, 0.3-0.7 mm, or other suitable width. The length of slot 122 may be more than 4 cm, more than 6 cm, more than 10 cm, 5-20 cm, 4-15 cm, less than 15 cm, less than 25 cm, or other suitable length.

Slot 122 may extend across rear housing wall 12R and, if desired, an associated sidewall such as sidewall 12W. Rear housing wall 12R may be planar or may be curved. Sidewall 12W may be an integral portion of rear wall 12R or may be a separate structure. Housing wall 12R (and, if desired, sidewalls such as sidewall 12W) may be formed from aluminum, stainless steel, or other metals and may form a ground plane for device 10. Slots in the ground plane such as slot 122 may be used in forming antenna resonating elements.

In the example of FIG. 2, slot 122 has a U-shaped footprint (i.e., the outline of slot 122 has a U shape when viewed along dimension Z). Other shapes for slot 122 may be used, if desired (e.g., straight shapes, shapes with curves, shapes with curved and straight segments, etc.). With a layout of the type shown in FIG. 2, the bends in slot 122 create space along the left and right edges of housing 12 for components 126. Components 126 may be, for example, speakers, microphones, cameras, sensors, or other electrical components.

Slot 122 may be divided into two shorter slots using a conductive member such as conductive structure 124 or a set of one or more switches that can be controlled by a control circuit. Conductive structure 124 may be formed from metal traces on a printed circuit, metal foil, metal portions of a housing bracket, wire, a sheet metal structure, or other conductive structure in device 10. Conductive structure 124 may be shorted to metal housing wall 12R on opposing sides of slot 122. If desired, conductive structures such as conductive structure 124 may be formed from integral portions of metal housing 12 and/or adjustable circuitry that bridges slot 122.

In the presence of conductive structure 124 (or when switches in structure 124 are closed), slot 122 may be divided into first and second slots 122L and 122R. Ends 122-1 of slots 122L and 122R are surrounded by air and dielectric structures such as glass or other dielectric associated with a display cover layer for display 14 and are therefore sometimes referred to as open slot ends. Ends 122-2 of slots 122L and 122R are terminated in conductive structure 124 and therefore are sometimes referred to as closed slot ends. In the example of FIG. 2, slot 122L is an open slot having an open end 122-1 and an opposing closed end 122-2. Slot 122R is likewise an open slot. If desired, device 10 may include closed slots (e.g., slots in which both ends are terminated with conductive structures). The configuration of FIG. 2 is merely illustrative.

Slot 122 may be fed using an indirect feeding arrangement. With indirect feeding, a structure such as a planar-inverted-F antenna resonating element may be near-field coupled to slot 122 and may serve as an indirect feed structure. The planar inverted-F antenna resonating element may also exhibit resonances that contribute to the frequency response of the antenna formed from slot 122 (i.e., the antenna may be a hybrid planar-inverted-F-slot antenna).

Figure 3:
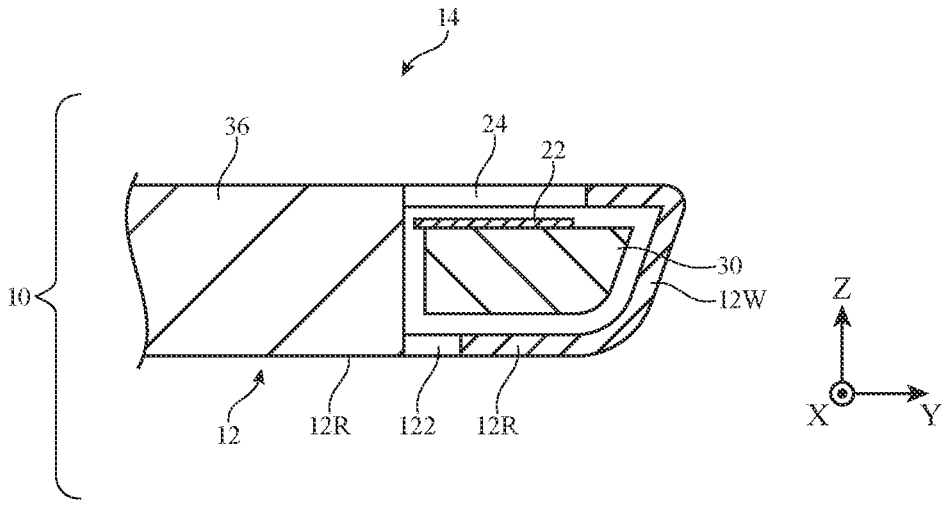
FIG. 3 is a cross-sectional side view of a portion of an illustrative electronic device in accordance with an embodiment.

A cross-sectional side view of device 10 in the vicinity of slot 122 is shown in FIG. 3. In the example of FIG. 3, conductive structures 36 may include display 14, conductive housing structures such as metal rear housing wall 12R, etc. Dielectric layer 24 may be a portion of a glass layer (e.g., a portion of a display cover layer for protecting display 14). The underside of layer 24 may, if desired, be covered with an opaque masking layer to block internal components in device 10 from view. Dielectric support 30 may be used to support conductive structures such as metal structure 22. Metal structure 22 may be located under dielectric layer 24 and may, if desired, be used in forming an antenna feed structure (e.g., structure 22 may be a planar metal member that forms part of a planar inverted-F antenna resonating element structure that is near-field coupled to slot 122 in housing 12). During operation, antenna signals associated with an antenna formed from slot 122 and/or metal structure 22 may be transmitted and received through the front of device 10 (e.g., through dielectric layer 24) and/or the rear of device 10.

Figure 4:
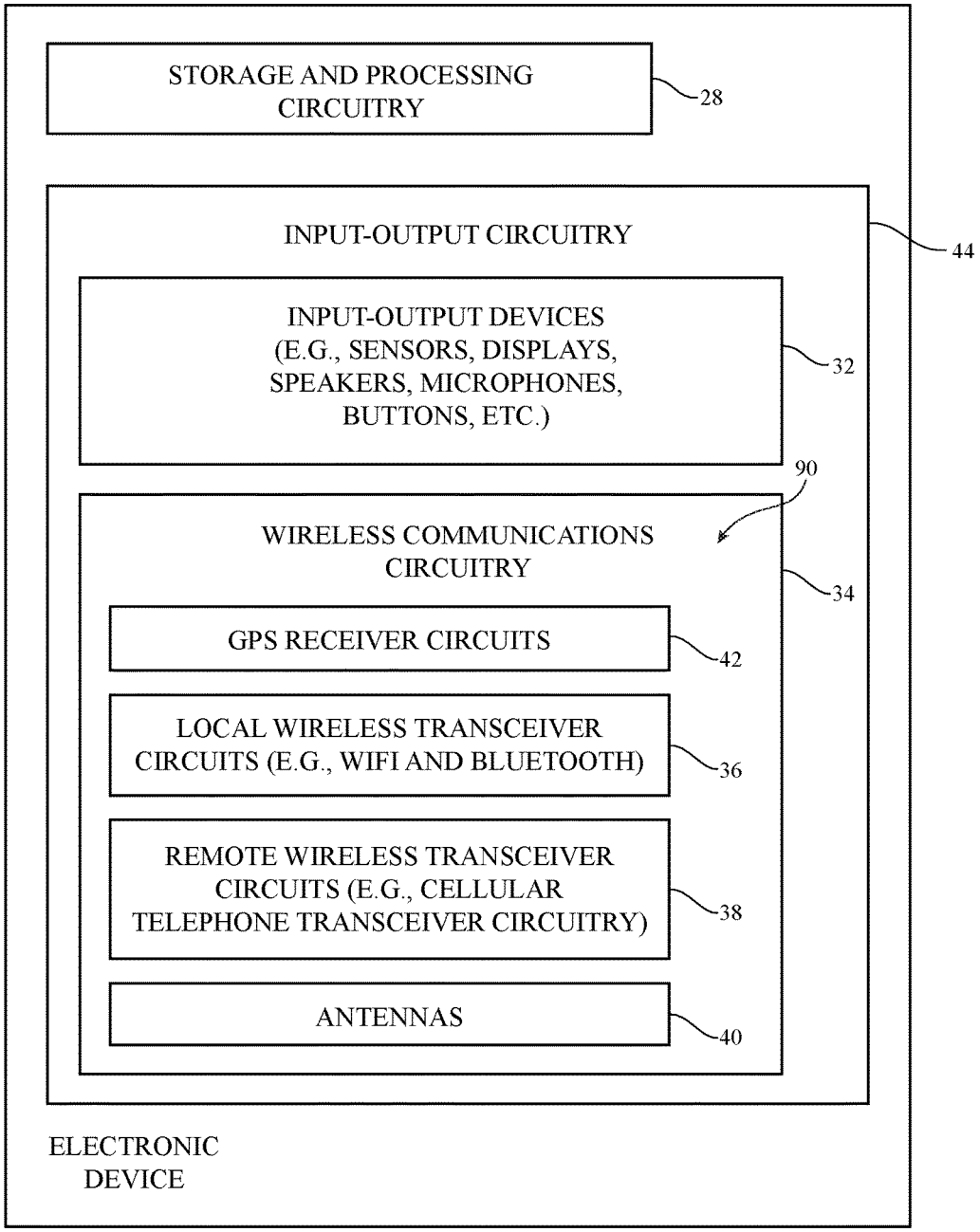
FIG. 4 is a schematic diagram of illustrative circuitry in an electronic device in accordance with an embodiment.

A schematic diagram showing illustrative components that may be used in device 10 is shown in FIG. 4. As shown in FIG. 4, device 10 may include control circuitry such as storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. This processing circuitry may be based on one or more microprocessors, microcontrollers, digital signal processors, application specific integrated circuits, etc.

Storage and processing circuitry 28 may be used to run software on device 10, such as internet browsing applications, voice-over-internet-protocol (VOIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols (e.g., IEEE 802.11 protocols—sometimes referred to as WiFi®), protocols for other short-range wireless communications links such as the Bluetooth® protocol, cellular telephone protocols, MIMO protocols, antenna diversity protocols, etc.

Input-output circuitry 44 may include input-output devices 32. Input-output devices 32 may be used to allow data to be supplied to device 10 and to allow data to be provided from device 10 to external devices. Input-output devices 32 may include user interface devices, data port devices, and other input-output components. For example, input-output devices 32 may include touch screens, displays without touch sensor capabilities, buttons, joysticks, scrolling wheels, touch pads, key pads, keyboards, microphones, cameras, buttons, speakers, status indicators, light sources, audio jacks and other audio port components, digital data port devices, light sensors, motion sensors (accelerometers), capacitance sensors, proximity sensors, etc.

Input-output circuitry 44 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas, transmission lines, and other circuitry for handling RF wireless signals. Wireless signals can also be sent using light (e.g., using infrared communications).

Wireless communications circuitry 34 may include radio-frequency transceiver circuitry 90 for handling various radio-frequency communications bands. For example, circuitry 34 may include transceiver circuitry 36, 38, and 42. Transceiver circuitry 36 may be wireless local area network transceiver circuitry that may handle 2.4 GHz and 5 GHz bands for WiFi® (IEEE 802.11) communications and that may handle the 2.4 GHz Bluetooth® communications band. Circuitry 34 may use cellular telephone transceiver circuitry 38 for handling wireless communications in frequency ranges such as a low communications band from 700 to 960 MHz, a midband from 1400 MHz or 1500 MHz to 2170 MHz (e.g., a midband with a peak at 1700 MHz), and a high band from 2170 or 2300 to 2700 MHz (e.g., a high band with a peak at 2400 MHz) or other communications bands between 700 MHz and 2700 MHz or other suitable frequencies (as examples). Circuitry 38 may handle voice data and non-voice data. Wireless communications circuitry 34 can include circuitry for other short-range and long-range wireless links if desired. For example, wireless communications circuitry 34 may include 60 GHz transceiver circuitry, circuitry for receiving television and radio signals, paging system transceivers, near field communications (NFC) circuitry, etc. Wireless communications circuitry 34 may include satellite navigation system circuitry such as global positioning system (GPS) receiver circuitry 42 for receiving GPS signals at 1575 MHz or for handling other satellite positioning data. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may include antennas 40. Antennas 40 may be formed using any suitable antenna types. For example, antennas 40 may include antennas with resonating elements that are formed from loop antenna structures, patch antenna structures, inverted-F antenna structures, slot antenna structures, planar inverted-F antenna structures, helical antenna structures, hybrids of these designs, etc. Different types of antennas may be used for different bands and combinations of bands. For example, one type of antenna may be used in forming a local wireless link antenna and another type of antenna may be used in forming a remote wireless link antenna.

Figure 5:
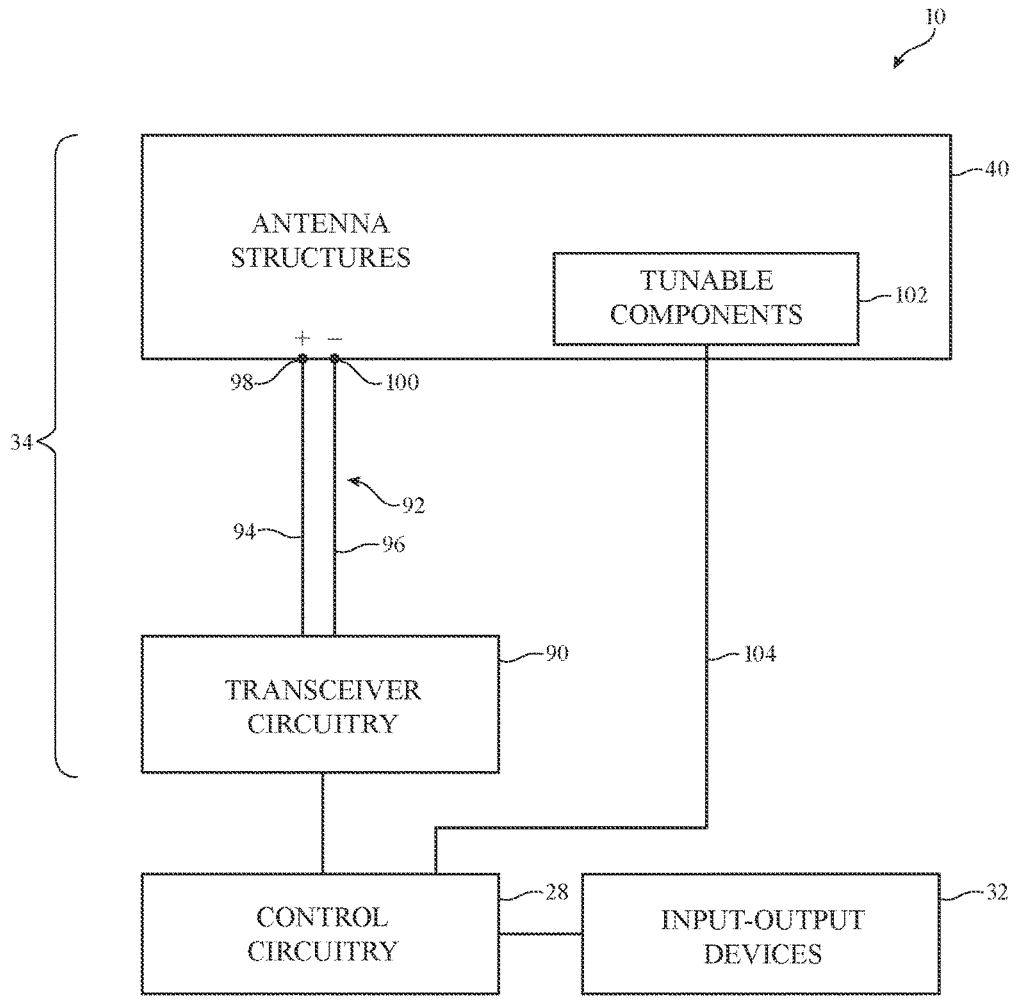
FIG. 5 is a diagram of illustrative wireless circuitry in an electronic device in accordance with an embodiment.

As shown in FIG. 5, transceiver circuitry 90 in wireless circuitry 34 may be coupled to antenna structures 40 using paths such as path 92. Wireless circuitry 34 may be coupled to control circuitry 28. Control circuitry 28 may be coupled to input-output devices 32. Input-output devices 32 may supply output from device 10 and may receive input from sources that are external to device 10.

To provide antenna structures 40 with the ability to cover communications frequencies of interest, antenna structures 40 may be provided with circuitry such as filter circuitry (e.g., one or more passive filters and/or one or more tunable filter circuits). Discrete components such as capacitors, inductors, and resistors may be incorporated into the filter circuitry. Capacitive structures, inductive structures, and resistive structures may also be formed from patterned metal structures (e.g., part of an antenna). If desired, antenna structures 40 may be provided with adjustable circuits such as tunable components 102 to tune antennas over communications bands of interest. Tunable components 102 may include tunable inductors, tunable capacitors, or other tunable components. Tunable components such as these may be based on switches and networks of fixed components, distributed metal structures that produce associated distributed capacitances and inductances, variable solid state devices for producing variable capacitance and inductance values, tunable filters, or other suitable tunable structures.

During operation of device 10, control circuitry 28 may issue control signals on one or more paths such as path 104 that adjust inductance values, capacitance values, or other parameters associated with tunable components 102, thereby tuning antenna structures 40 to cover desired communications bands.

Path 92 may include one or more transmission lines. As an example, signal path 92 of FIG. 5 may be a transmission line having first and second conductive paths such as paths 94 and 96, respectively. Path 94 may be a positive signal line and path 96 may be a ground signal line. Lines 94 and 96 may form parts of a coaxial cable or a microstrip transmission line (as examples). A matching network formed from components such as inductors, resistors, and capacitors may be used in matching the impedance of antenna structures 40 to the impedance of transmission line 92. Matching network components may be provided as discrete components (e.g., surface mount technology components) or may be formed from housing structures, printed circuit board structures, traces on plastic supports, etc. Components such as these may also be used in forming filter circuitry in antenna structures 40.

Transmission line 92 may be directly coupled to an antenna resonating element and ground for antenna 40 or may be coupled to near-field-coupled antenna feed structures that are used in indirectly feeding a resonating element for antenna 40. As an example, antenna structures 40 may form an inverted-F antenna, a slot antenna, a hybrid inverted-F slot antenna or other antenna having an antenna feed with a positive antenna feed terminal such as terminal 98 and a ground antenna feed terminal such as ground antenna feed terminal 100. Positive transmission line conductor 94 may be coupled to positive antenna feed terminal 98 and ground transmission line conductor 96 may be coupled to ground antenna feed terminal 92. Antenna structures 40 may include an antenna resonating element such as a slot antenna resonating element or other element that is indirectly fed using near-field coupling. In a near-field coupling arrangement, transmission line 92 is coupled to a near-field-coupled antenna feed structure that is used to indirectly feed antenna structures such as an antenna slot or other element through near-field electromagnetic coupling.

Figure 6:
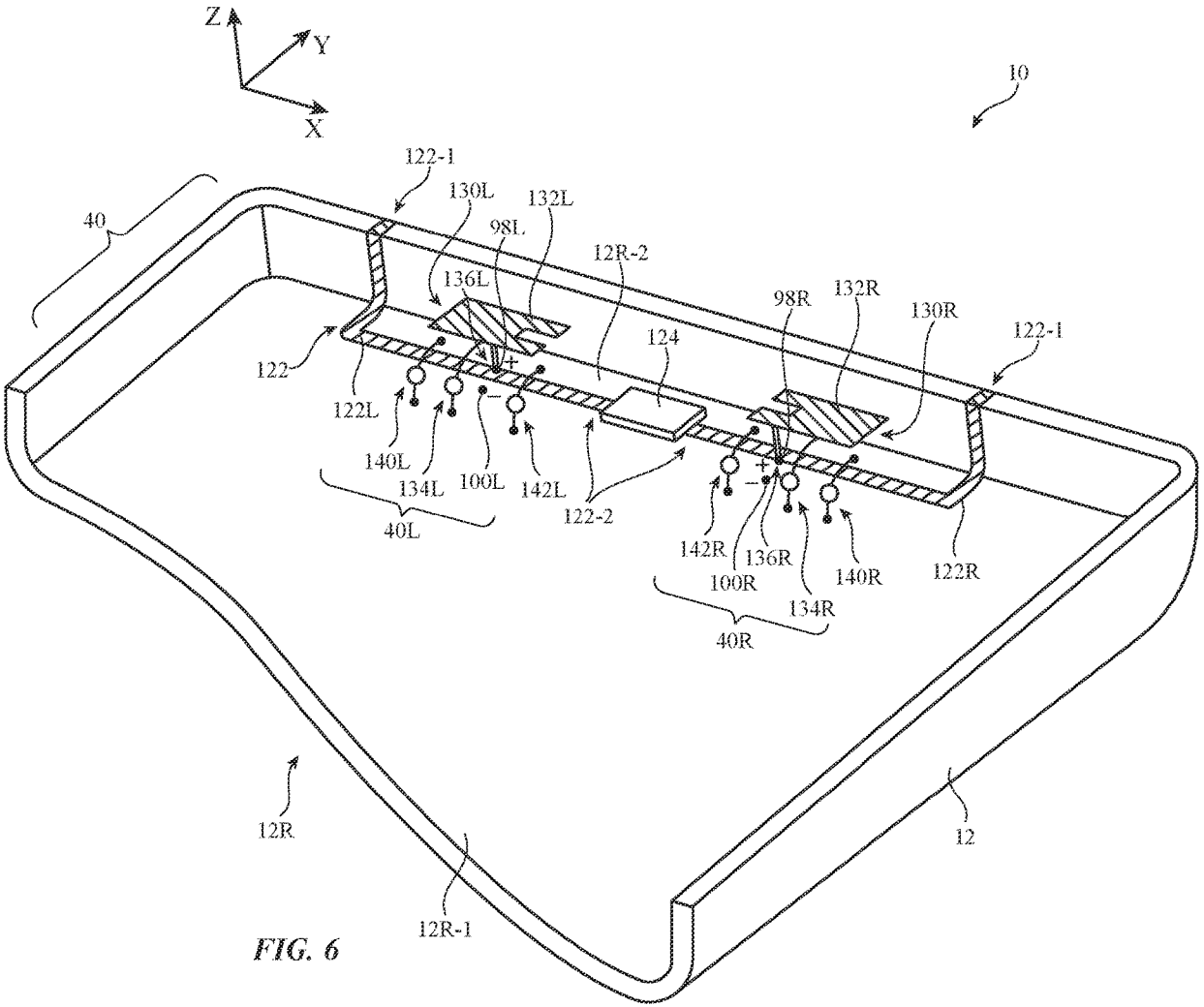
FIG. 6 is a perspective interior view of an illustrative electronic device with a metal housing having a dielectric-filled slot such as a plastic-filled slot that has been divided into left and right slots for hybrid planar inverted-F-slot antennas by a conductive structure that bridges the slot in accordance with an embodiment.

Antennas 40 may include hybrid antennas formed both from inverted-F antenna structures (e.g., planar inverted-F antenna structures) and slot antenna structures. An illustrative configuration in which device 10 has two hybrid antennas formed from the left and right portions of slot 122 in housing 12 is shown in FIG. 6. FIG. 6 is an interior perspective view of device 10 at the upper end of housing 12. As shown in FIG. 6, slot 122 may be divided into left slot 122L and right slot 122R by conductive structures 124 that bridge the center of slot 122. Rear housing wall 12R (e.g., a metal housing wall in housing 12) may have a first portion such as portion 12R-1 and a second portion such as portion 12R-2 that is separated from portion 12R-1 by slot 122. Conductive structures 124 may be shorted to rear housing wall portion 12R-1 on one side of slot 122 and may be shorted to rear housing wall portion 12R-2 on the other side of slot 122. The presence of the short circuit formed by structures 124 across slot 122 creates closed ends 122-2 for left slot 122L and right slot 122R.

Antennas 40 of FIG. 6 include left antenna 40L and right antenna 40R. Device 10 may switch between antennas 40L and 40R in real time to ensure that signal strength is maximized, may use antennas 40L and 40R simultaneously, or may otherwise use antennas 40L and 40R to enhance wireless performance for device 10.

Left antenna 40L and right antenna 40R may be hybrid planar-inverted-F-slot antennas each of which has a planar inverted-F antenna resonating element and a slot antenna resonating element.

The slot antenna resonating element of antenna 40L may be formed by slot 122L. Planar-inverted-F resonating element 130L serves as an indirect feeding structure for antenna 40L and is near-field coupled to the slot resonating element formed from slot 122L. During operation, slot 122L and element 130L may each contribute to the overall frequency response of antenna 40L. As shown in FIG. 6, antenna 40L may have an antenna feed such as feed 136L. Feed 136L is coupled between planar inverted-F antenna resonating element 130L and ground (i.e., metal housing 12R-1). A transmission line (see, e.g., transmission line 92 of FIG. 5) may be coupled between transceiver circuitry 90 and antenna feed 136L. Feed 136L has positive antenna feed terminal 98L and ground antenna feed terminal 100L. Ground antenna feed terminal 100L may be shorted to ground (e.g., metal wall 12R-1). Positive antenna feed terminal 98L may be coupled to planar metal element 132L via a leg or other conductive path that extends downwards from planar-inverted-F antenna resonating element 130L towards the ground formed from metal wall 12R-1. Planar-inverted-F antenna resonating element 130L may also have a return path such as return path 134L that is coupled between planar element 132L and antenna ground (metal housing 12R-1) in parallel with feed 136L.

The slot antenna resonating element of antenna 40R is formed by slot 122R. Planar-inverted-F resonating element 130R serves as an indirect feeding structure for antenna 40R and is near-field coupled to the slot resonating element formed from slot 122R. Slot 122R and element 130R both contribute to the overall frequency response of hybrid planar-inverted-F-slot antenna 40R. Antenna 40R may have an antenna feed such as feed 136R. Feed 136R is coupled between planar inverted-F antenna resonating element 130R and ground (metal housing 12R-1). A transmission line such as transmission line 92 may be coupled between transceiver circuitry 90 and antenna feed 136R. Feed 136R may have positive antenna feed terminal 98R and ground antenna feed terminal 100R. Ground antenna feed terminal 100R may be shorted to ground (e.g., metal wall 12R-1). Positive antenna feed terminal 98R may be coupled to planar metal structure 132R of planar-inverted-F antenna resonating element 130R. Planar-inverted-F antenna resonating element 130R may have a return path such as return path 134R that is coupled between planar element 132R and antenna ground (metal housing 12R-1).

Return paths 134L and 134R may be formed from strips of metal without any tunable components or may include tunable inductors or other adjustable circuits for tuning antennas 40. Additional tunable components may also be incorporated into antennas 40, if desired. For example, tunable (adjustable) components 140L and 142L may bridge slot 122L in antenna 40L and tunable (adjustable) components 140R and 142R may bridge slot 122R in antenna 40R.

Figure 7:
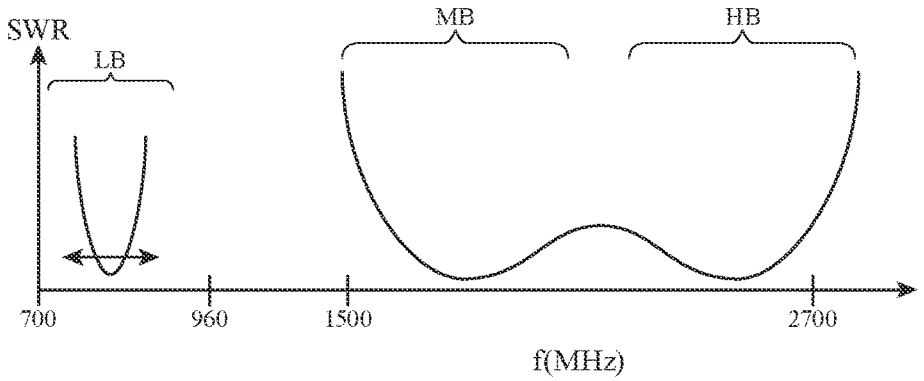
FIG. 7 is a graph of antenna performance (standing wave ratio SWR) plotted as a function of operating frequency for an illustrative antenna of the type shown in FIG. 6 in accordance with an embodiment.

Antennas 40 may support any suitable frequencies of operation. As an example, antennas 40 may operate in a low band LB, midband MB, and high band HB, as shown in the graph of FIG. 7 in which antenna performance (standing wave ratio SWR) has been plotted as a function of operating frequency f. Slots 122L and 122R may have lengths (quarter wavelength lengths) that support resonances in low communications band LB (e.g., a low band at frequencies between 700 and 960 MHz). Midband coverage (e.g., for a midband MB from 1400 or 1500 MHz to 1.9 GHz or other suitable midband range) may be provided by the resonance exhibited by planar inverted-F antenna resonating elements 130L and 130R. High band coverage (e.g., for a high band centered at 2400 MHz and extending to 2700 MHz or other suitable frequency) may be supported using harmonics of the slot antenna resonating element resonance (e.g., a third order harmonic, etc.).

Figure 8:
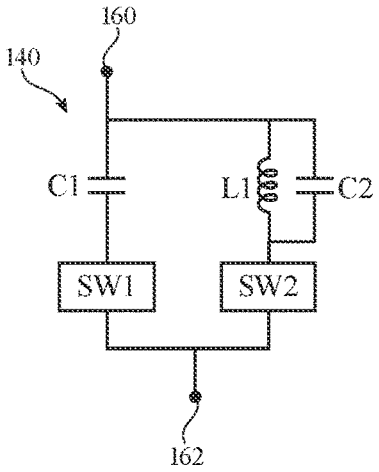
FIGS. 8, 9, 10, and 11 are diagrams of illustrative adjustable circuitry for tuning antenna performance for antennas of the type shown in FIG. 6 in accordance with embodiments.
Figure 9:
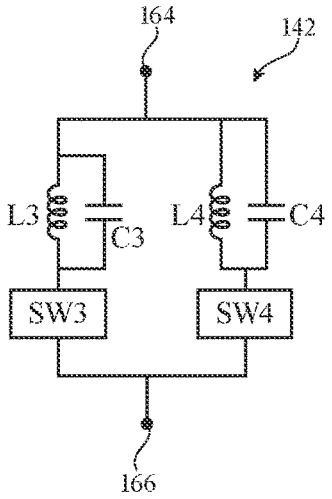

Tuning circuits (see, e.g., components 102 of FIG. 5) may be used in adjusting antenna frequency response. Illustrative antenna tuning circuitry for antennas 40 is shown in FIGS. 8, 9, 10, and 11. The adjustable circuits for antenna tuning that are shown in FIGS. 8 and 9 may include capacitors that can bridge slot 122. This may help allow the width of conductive structure 124 to be widened to improve isolation between antennas 40L and 40R without overly increasing the frequency of operation of antennas 40L and 40R due to the resulting decrease in the lengths of slots 122L and 122R. Switchable inductors in these circuits may help tune antenna resonance peaks to cover frequencies of interest.

Tunable circuitry such as tunable circuit 140 of FIG. 8 may be used for implementing tunable circuit 140L and/or tunable circuit 140R of FIG. 6. Tunable circuit 140 includes first terminal 160 and second terminal 162. Two respective branches of circuitry each having different circuit components may be coupled between terminals 160 and 162 in parallel. Switches SW1 and SW2 may be turned on or off to switch the circuitry of circuit 140 into or out of use. In the illustrative configuration of FIG. 8, a capacitor C1 (i.e., a capacitor without a parallel inductor) is switched into use when switch SW1 is closed and is switched out of use when switch SW1 is opened. Switch SW2 is closed when it is desired to switch inductor L1 and capacitor C2 into use and may otherwise be opened.

Tunable circuitry such as tunable circuit 142 of FIG. 9 may be used for implementing tunable circuit 142L and/or tunable circuit 142R of FIG. 6. Tunable circuit 142 includes first terminal 164 and second terminal 166. Two respective branches of circuitry each having different circuit components are coupled between terminals 164 and 166 in parallel in the illustrative configuration of FIG. 9. Capacitor C2 and inductor L3 of circuit 142 are switched into use when switch SW3 is closed and are switched out of use when switch SW3 is opened. Switch SW4 is closed when it is desired to switch inductor L4 and capacitor C4 into use and may otherwise be opened. Switches SW3 and SW4 may be turned on or off to switch the circuitry of circuit 142 into or out of use.

Switching circuitry in circuits 140 and 142 such as switches SW1, SW2, SW3, and SW4 may be adjusted by control signals from control circuitry 28 based on real-time impedance measurements, received signal strength information, or other information.

If desired, one or more switchable inductors or other adjustable circuitry may be incorporated into return path 134L and/or return path 134R (e.g., to switch an inductor L1 into use when tuning antennas 40 to cover midband MB and to switch a short circuit path into use when tuning antennas 40 to cover low band LB). Configurations in which return paths 134L and 134R are formed from strips of metal, metal traces on a printed circuit or plastic carrier, or other short circuit paths without tunable components may also be used.

Using circuits such as circuits 140 and 142 of FIGS. 8 and 9, the low band antenna resonance associated with each of antennas 40 can be tuned. For example, the low band resonance of each antenna may be centered on a first frequency in band LB when switch SW1 is on and SW2, SW3, and SW4 are off, may be centered on a second frequency in band LB that is greater than the first frequency when SW1, SW2, SW3, and SW4 are off, may be centered on a third frequency in band LB that is greater than the second frequency when SW3 is on, SW1 is off, SW2 is off, and SW4 is off, and may be centered on a fourth frequency in band LB that is greater than the third frequency when SW3 and SW4 are on and SW1 and SW2 are off. In low band LB, inductors L1 and L3, and L4 provide low band tuning, but tend to pull resonant frequencies high. The capacitors in circuits 140 and 142 help lower the resonant frequencies to suitable values.

Antennas 40L and 40R may cover identical sets of frequencies or may cover overlapping or mutually exclusive sets of frequencies. As an example, antenna 40R may serve as a primary antenna for device 10 and may cover frequencies of 700-960 MHz and 1700-2700 MHz, whereas antenna 40L may serve as a secondary antenna that covers frequencies of 700-960 MHz and 1575-2700 MHz (or 1500-2700 MHz or 1400-2700 MHz, etc.). Global positioning system (GPS) signals are associated with the frequency of 1575 MHz. To help ensure that antenna 40L covers GPS signals, return path 134L may be formed from an inductor (e.g., a surface mount technology inductor or other packaged inductor), whereas return path 134R in antenna 40R may be formed from a strip of metal or other short circuit path.

The presence of the body of a user (e.g., a user's hand) or other external objects in the vicinity of antennas 40 may change the operating environment and tuning of antennas 40. For example, the presence of an external object may shift the low band resonance of antennas 40 to lower frequencies. Real time antenna tuning using the adjustable components of FIGS. 8 and 9 and/or other adjustable components may be used to ensure that antennas 40 operate satisfactorily regardless of whether external objects adjacent to antennas 40 are loading antennas 40. For example, one or more inductors may be switched into use in circuits 140 and 142 (e.g., by closing some or all of the switches in circuits 140 and 142) to tune antenna resonant frequencies for antennas 40 to higher frequencies.

Figure 10:
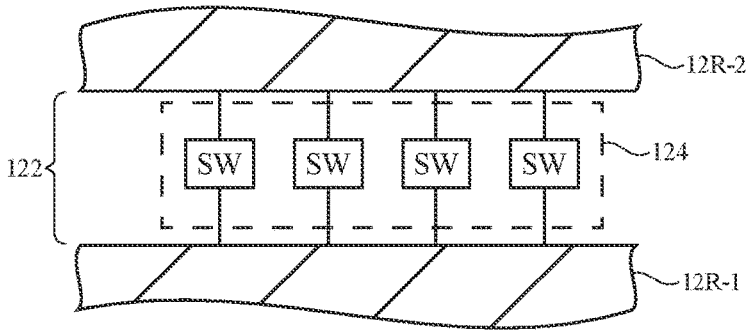

If desired, conductive structure 124 can be implemented using an array of switches each of which bridges slot 122, as shown in FIG. 10. In the illustrative configuration of FIG. 10, there is a set of four switches SW bridging slot 122. If desired, a single switch or more than four or fewer than four switches may be provided in the set of switches implementing conductive structures 124. During normal operation, the switches of FIG. 10 may be closed. When the presence of an external object is detected in the vicinity of antennas 40 that affects antenna operation (e.g., by measuring changes in impedance for antennas 40L and 40R using impedance monitoring circuitry coupled to antennas 40L and 40R, by measuring received signal strength information for each of antennas 40L and 40R, by using proximity detector measurements, etc.), the circuitry of FIG. 10 can be adjusted accordingly. As an example, if an external object is detected and if antenna 40L is performing better than antenna 40R (as determined by impedance measurements, received signal strength information measurements, etc.), than switches SW of FIG. 10 can be opened and antenna 40R can be disconnected. With switches SW open, slots 122L and 122R will no longer be isolated by a conductive path shorting portions 12R-1 and 12R-2 and will join to form a single large open-ended slot with electric fields at the ends of the slot that are less concentrated than they otherwise would be at the end of a slot with one open and one closed end (i.e., with switches SW all open, the conductive bridging structure that would otherwise short 12R-1 and 12R-2 together is selectively removed). This reduces the sensitivity of slot 122 and therefore antenna 40L to the presence of external objects. If desired, tunable components may be adjusted to restore the frequency response of antenna 40L to a desired set of frequencies in the presence of an external object.

Figure 11:
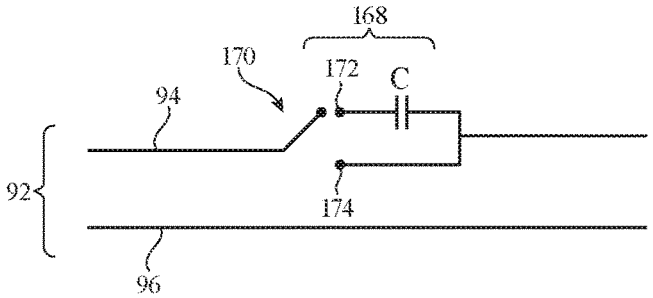

FIG. 11 is a diagram showing how adjustable circuitry 168 (e.g., adjustable impedance matching circuitry) may be incorporated into transmission line 92 to adjust the operation of antennas 40L and/or 40R in response to changes in operating environment (e.g., the presence or absence of external objects in the vicinity of antenna 40). The adjustable impedance matching circuitry of FIG. 11 may be used in conjunction with adjustable circuitry such as the circuitry of FIGS. 8, 9, and 10, adjustable return path circuitry, and/or other adjustable circuitry or may be used independently. As shown in FIG. 11, path 92 may include lines 94 and 96. Circuitry 168 may include switch 170 in line 94 that allows a component such as capacitor C to be selectively bypassed. During normal operation, capacitor C may be bypassed by connecting switch 170 to terminal 174. In the presence of an external object that is affecting the performance of antenna 40L and/or 40R, switch 170 may be coupled to terminal 172 to switch capacitor C into use and thereby tune the antenna that is associated with path 92 to compensate for the presence of the external object.

If desired, an adjustable inductor or other tunable component in the return path of each antenna (i.e., in the short circuit path between element 132L and the antenna ground formed from rear housing 12R-1 and/or the short circuit path between element 132R and ground) may be adjusted to help tune antenna performance in midband MB. Configurations in which return path 132L and/or return path 132R do not include adjustable components may also be used.

Figure 12:
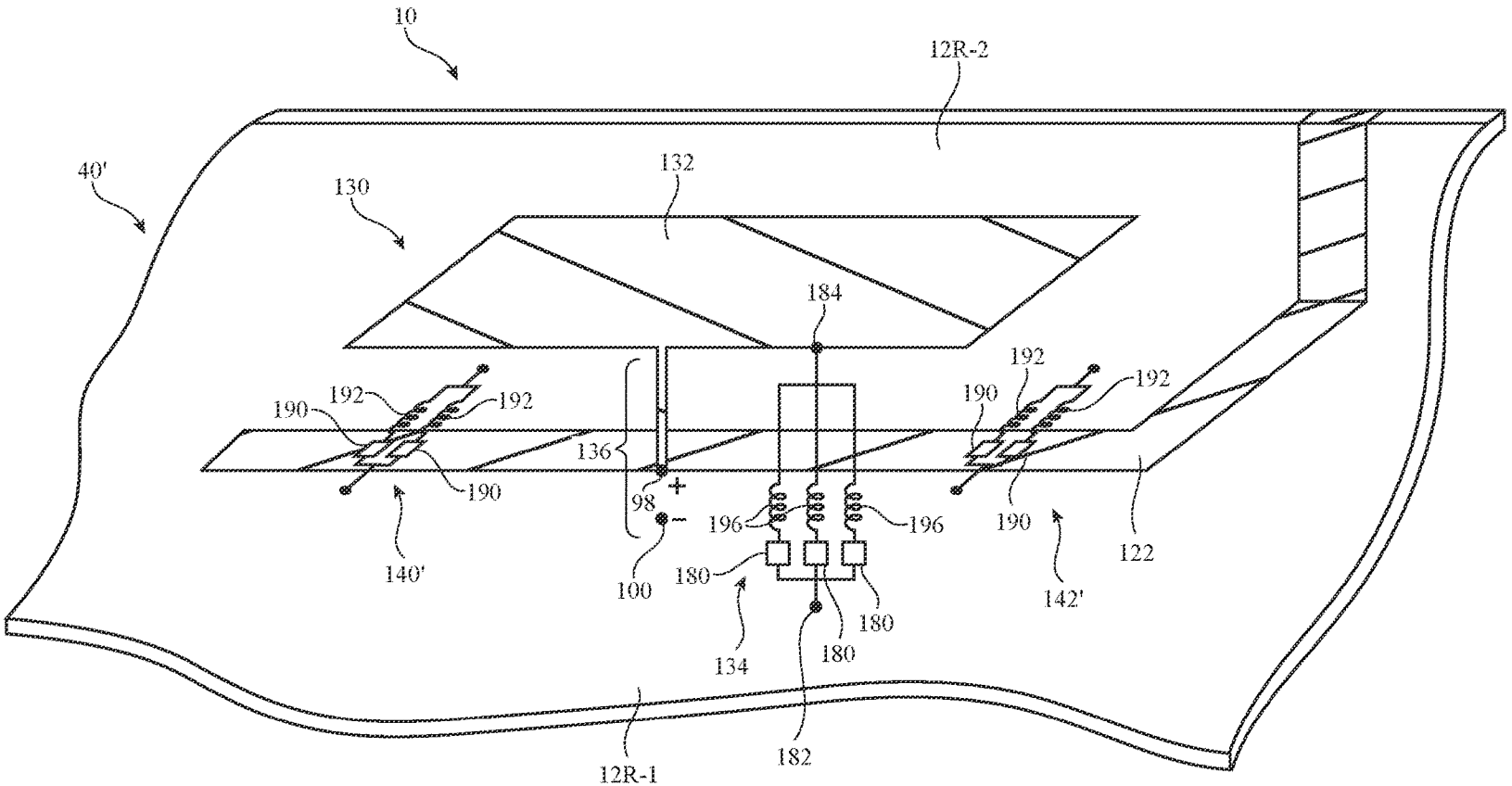
FIG. 12 is a perspective view of an illustrative hybrid antenna with a return path that includes an adjustable circuit such as an adjustable inductor having switching circuitry coupled to three inductors in accordance with an embodiment.

FIG. 12 is a diagram of illustrative antenna configuration for device 10 in which the antenna return path includes an adjustable component. Antenna 40' of FIG. 12 may be used in implementing an antenna such as antenna 40R and/or 40L of FIG. 6. In the arrangement of FIG. 12, planar inverted-F antenna resonating element 130 is formed from planar metal structure 132. Structure 132 may overlap slot 122. Antenna 40' may be a hybrid antenna that includes a planar inverted-F antenna formed from resonating element 130 and ground (metal housing 12R-1 and 12R-2) and that includes the slot antenna formed from slot 122. Antenna 130 may serve as an indirect feed for the slot antenna formed from slot 122. Transmission line 92 may be coupled to terminals 98 and 100 of feed 136 for antenna 130. Return path 134 may be coupled between element 132 and the antenna ground formed from metal housing 12R-1 in parallel with feed 136. Return path 134 may include an adjustable circuit such as an adjustable inductor. The adjustable inductor may include switching circuitry such as switches 180 and respective inductors 196 coupled in parallel between terminal 182 on the ground formed from metal 12R-1 and terminal 184 on element 132. Control circuitry 28 may adjust adjustable circuits in device 10 such as adjustable return path circuit 134 of FIG. 12 to tune antenna 40'. For example, switches 180 may be selectively opened and/or closed to switch desired inductors 196 into or out of use, thereby adjusting the inductance of the adjustable circuitry of return path 134.

Antenna 40' of FIG. 12 may also have adjustable circuitry such as adjustable circuits 140' and 142' that bridge slot 122. Circuits 140' and 142' may have inductors 192 or other circuit components that can be selectively switched into or out of use with switching circuitry such as switches 190. If desired, capacitors may be coupled in parallel with one or more of inductors 192, as described in connection with FIGS. 8 and 9.

During operation, antenna 40' may operate in frequency bands such as low band LB, midband MB (e.g., a midband that extends down to 1400 MHz or other suitable frequency), and high band HB of FIG. 7. Circuits 140' and 142' (e.g., adjustable inductors formed from switching circuitry and individual inductors with our without capacitors coupled in parallel with the individual inductors) may be used to tune antenna 40' in low band LB. The adjustable inductor of return path 134 may be used to provide multiple tuning states for midband MB. In scenarios in which the presence of an external object adjacent to slot 122 affects the operation of antenna 40' (e.g., by shifting the low band resonance of antenna 40' low), switches 180 may be opened, thereby shifting the low band resonance of antenna 40' high to compensate. Tuning within low band LB may then be performed by adjusting the inductances of circuits 140' and 142'.

The foregoing is merely illustrative and various modifications can be made by those skilled in the art without departing from the scope and spirit of the described embodiments. The foregoing embodiments may be implemented individually or in any combination.

What is claimed is:

1. An electronic device, comprising:

a housing having a metal housing wall that forms a ground plane;

a slot in the metal housing wall that forms a slot antenna resonating element for a hybrid antenna;

a planar inverted-F antenna resonating element for the hybrid antenna;

an antenna feed having a positive antenna feed terminal and a ground antenna feed terminal coupled between the planar inverted-F antenna resonating element and the ground plane; and a return path coupled between the planar inverted-F antenna resonating element and the ground plane in parallel with the antenna feed, wherein the return path includes an adjustable circuit; and an additional adjustable circuit that bridges the slot.

2. The electronic device defined in claim 1 wherein the adjustable circuit comprises an adjustable inductor.

3. The electronic device defined in claim 2 wherein the adjustable inductor comprises a plurality of inductors and switching circuitry.

4. The electronic device defined in claim 3 further comprising control circuitry that is configured to tune an antenna resonance for the hybrid antenna by adjusting the additional adjustable circuit that bridges the slot.

5. The electronic device defined in claim 4 wherein the control circuitry is configured to adjust the adjustable inductor to compensate for the presence of an external object adjacent to the slot.

6. The electronic device defined in claim 1 further comprising:

first and a second additional adjustable circuit, wherein the additional adjustable circuit and the second additional adjustable circuit that bridge the slot on opposing sides of the ground antenna feed terminal.

7. The electronic device defined in claim 6 wherein the first additional and second additional adjustable circuits each include switching circuitry and at least one inductor.

8. The electronic device defined in claim 7 wherein the first additional and second additional adjustable circuits each include a capacitor coupled in series with the at least one inductor.

9. The electronic device defined in claim 8 wherein the adjustable circuit of the return path comprises an adjustable inductor.

10. The electronic device defined in claim 9 wherein the adjustable inductor of the return path includes at least three inductors and switching circuitry coupled to the at least three inductors.

11. The electronic device defined in claim 10 wherein the ground plane has first and second ground plane portions on opposing sides of the slot and wherein the return path and the ground antenna feed terminal are both coupled to the first ground plane portion.

12. The electronic device defined in claim 1 further comprising:

a transmission line coupled to the antenna feed, wherein the transmission line includes an adjustable component that is adjusted to tune the antenna.

13. The electronic device defined in claim 1, wherein the planar inverted-F antenna resonating element overlaps only a portion of the slot.

14. An electronic device, comprising:

a metal housing that forms a ground plane, wherein the metal housing has a dielectric-filled slot that separates the metal housing into first and second portions and that is divided into first and second slots by at least one switch that bridges the slot, and the at least one switch is configured to form a conductive path that electrically shorts the first portion of the metal housing to the second portion of the metal housing in a mode of operation;

a first hybrid antenna that includes:

a first slot antenna resonating element formed from the first slot;

a first planar inverted-F antenna resonating element that indirectly feeds the first slot antenna; and a second hybrid antenna that includes:

a second slot antenna resonating element formed from the second slot;

a second planar inverted-F antenna resonating element that indirectly feeds the second slot antenna.

15. The electronic device defined in claim 14 further comprising:

a return path having a tunable inductor that is coupled between the first planar inverted-F antenna resonating element and the ground plane.

16. The electronic device defined in claim 15 further comprising a tunable component that bridges the slot, wherein the tunable component includes switching circuity, inductors coupled to the switching circuitry, and capacitors coupled to the switching circuitry in parallel with the inductors.

17. The electronic device defined in claim 15 wherein the at least one switch comprises a plurality of switches that bridge the slot.

18. An antenna, comprising:

a metal electronic device housing wall;

a slot in the metal electronic device housing wall, wherein the slot divides the metal electronic device housing wall into first and second portions that are respectively located on opposing first and second sides of the slot;

a planar inverted-F antenna resonating element that has a planar metal element, a return path formed on the first side of the slot and coupled between the planar metal element and the first portion of the metal electronic device housing wall, and an antenna feed having a positive antenna feed terminal on the first side of the slot and a ground antenna feed terminal on the first side of the slot coupled respectively to the planar metal element and the first portion of the metal electronic device housing wall; and a tunable circuit containing a capacitor that bridges the slot.

19. The antenna defined in claim 18 wherein the tunable circuit includes switching circuitry to which the capacitor is coupled and includes a plurality of inductors coupled to the switching circuitry.

20. The antenna defined in claim 19 further comprising a tunable inductor in the return path.

21. The electronic device defined in claim 14 wherein the metal housing comprises a rear wall of the housing, the electronic device further comprising:

a dielectric layer at a front of the housing, wherein the first planar inverted-F antenna resonating element is separated from the second planar inverted-F antenna resonating element by a gap, the first and second planar inverted-F antenna resonating elements are interposed between the dielectric layer and the rear wall.

* * * * *